US007690299B2

(12) United States Patent
Ogawa

(10) Patent No.: US 7,690,299 B2
(45) Date of Patent: Apr. 6, 2010

(54) PRINTING RUBBER BLANKET

(75) Inventor: Yoshiharu Ogawa, Nishiibaraki-gun (JP)

(73) Assignee: Kinyosha Co., Ltd., Tokyo (JP)

( * ) Notice: Subject to any disclaimer, the term of this patent is extended or adjusted under 35 U.S.C. 154(b) by 425 days.

(21) Appl. No.: 11/509,880

(22) Filed: Aug. 24, 2006

(65) Prior Publication Data

US 2007/0169653 A1 Jul. 26, 2007

(30) Foreign Application Priority Data

Jan. 19, 2006 (JP) ..... 2006-011459

(51) Int. Cl.
*B41N 10/04* (2006.01)
*B41N 10/02* (2006.01)

(52) U.S. Cl. ..... 101/376; 101/375; 428/909

(58) Field of Classification Search ..... 101/375, 101/376; 428/241, 246
See application file for complete search history.

(56) References Cited

U.S. PATENT DOCUMENTS 5,066,537 A 11/1991 O'Rell et al.
5,498,470 A 3/1996 McLean et al.
5,549,968 A * 8/1996 Byers et al. ..... 442/70
5,910,095 A * 6/1999 Strasser et al. ..... 60/272
6,132,328 A * 10/2000 Kinoshita et al. ..... 474/260
6,794,319 B2 * 9/2004 Rose et al. ..... 442/203
6,968,866 B2 * 11/2005 Torii et al. ..... 139/420 R
2001/0032560 A1 10/2001 Andrew et al.
2003/0066449 A1 * 4/2003 Iwasaki ..... 101/376
2006/0085999 A1 * 4/2006 Scherb et al. ..... 34/453

FOREIGN PATENT DOCUMENTS

JP 6-297877 10/1994
JP 2000-343853 12/2000

OTHER PUBLICATIONS

Swicofil Manual—Yarn Numbering, www.swicofil.com, Jun. 13, 2003, http://web.archive.org.*
Oct. 26, 2006 EPO Communication and European Search Report.

* cited by examiner

*Primary Examiner*—Daniel J Colilla
(74) *Attorney, Agent, or Firm*—John P. White; Cooper & Dunham LLP

(57) ABSTRACT

A printing blanket is designed to have less sink-down, less variation in thickness along with time, less susceptible to temperature or moisture, and which employs woven fabric having excellent measurement stability, thereby having a sufficient durability against variation in thickness in high-speed printing. The printing rubber blanket includes a surface rubber layer, and at least two fabric layers, in which at least one of the fabric layers other than that located adjacent to the surface rubber layer is woven fabric made of a yarn of No. 10 count or less but No. 6 count or more used for warps of the woven fabric, and a yarn of No. 30 count or less but No. 20 count or more used for wefts of the woven fabric, and the woven fabric is subjected to a stretching process in which the woven fabric is expanded in the warp direction.

12 Claims, 3 Drawing Sheets

PRINTING RUBBER BLANKET

CROSS-REFERENCE TO RELATED APPLICATIONS

This application is based upon and claims the benefit of priority from prior Japanese Patent Application No. 2006-011459, filed Jan. 19, 2006, the entire contents of which are incorporated herein by reference.

BACKGROUND OF THE INVENTION

1. Field of the Invention

The present invention relates to a printing rubber blanket used in lithography, and more specifically to a printing rubber blanket with which sinking down of the rubber blanket, which occurs while using the blanket, can be reduced, and the reduction of thickness of the rubber blanket is less, thereby achieving an excellent durability.

2. Description of the Related Art

The lithographic offset press printing operates in the following manner. First, the printing rubber blanket rotates while being brought into tight contact with the plate cylinder on which characters and images are formed and printing ink is provided, and thus the ink of the characters and images on the plate cylinder is transferred onto the rubber blanket. Then, the characters and images on the rubber blanket are (transferred and) set on a print medium such as paper sheet, which is conveyed as being brought into tight contact with the rubber blanket, thereby carrying out printing.

The rubber blanket, which is conventionally employed, includes a smooth surface rubber layer having a thickness of about 0.4 mm, a fabric layer underlying the rubber layer to integrally adhered to the surface rubber layer, a compression layer underlying the fabric layer to integrally adhered to the fabric layer, and two to four fabric layers that are stacked one on another via adhesive layers alternately under the compression layer. The total thickness of the printing rubber blanket is in a range of 1.16 to 3 mm.

As shown in FIG. 3, the printing rubber blanket is wound around the cylinder at a high tension. FIG. 3 illustrates a rubber blanket 1, a blanket cylinder 2, which is a cylinder around which the rubber blanket is wound, and a bar member 3 mounted on an end portion of the rubber blanket 1.

The lithographic offset press that uses such a rubber blanket as described above, applies a very high printing pressure between the plate cylinder and the rubber blanket and also a very high transferring pressure between the rubber blanket and the impression cylinder in order to obtain a print that has no uneven density on its printed surface but has an excellent reappearance of halftone.

Therefore, in actual printing, the rubber blanket used here undergoes severe dynamic shock repeatedly. As a result, the rubber blanket, as it is used, loses its thickness, which is the phenomenon called "sink down". As the rubber blanket sinks down and the thickness of the rubber blanket reduces, the printing pressure acting between the plate cylinder and the rubber blanket naturally reduces.

As the reduction in the printing pressure between the plate cylinder and the rubber blanket occurs, the transfer of the ink from the plate cylinder is not properly performed, and the transfer of the ink is not sufficiently carried out. Especially, in the case where the rubber blanket is used under severe conditions such as in high-speed printing, the sink-down of the rubber blanket is further promoted, and therefore it is likely that the reduction in the thickness of the rubber blanket occurs in an early stage. Under these circumference, the life of the rubber blanket is significantly shortened in the case of high-speed printing, at present.

It is well known that one of the main factors of the sink-down of a rubber blanket is the reduction in thickness of the woven fabric of the fabric layer of the blanket. In order to suppress the sink-down of the rubber blanket, thereby decreasing the reduction in the thickness of the rubber blanket, the following technique is conventionally known. That is, the woven fabric of the fabric layer used for the rubber blanket is in advance subjected to calendering, in which fabric are allowed to pass between calendar rolls to be crimped, and thus the thickness of the woven fabric is reduced in advance.

FIG. 7 shows the calendering of woven fabric 4, which serves as the fabric. FIG. 7 illustrates a pair of calendar rolls 5 and 6. The pair of calendar rolls 5 and 6 may be a pair of a metal roll and a metal roll, or a metal roll and a resin roll. The woven fabric 4 is passed through the gap between the calendar rolls 5 and 6, thereby compressing by pressing the woven fabric 4 in advance. A rubber blanket that uses a highly dense woven fabric prepared by the compression, as its fabric layer, can reduce the sink-down.

In rubber blankets, there is a close relationship between the degree of the sink-down of the fabric and the density of the woven fabric of the fabric layer.

It is known that the woven fabric applied to a rubber blanket exhibits a larger sink-down degree as the density of the woven fabric is lower, after repetitious compression when the rubber blanket that uses the fabric is actually used. Therefore, the calendering of the woven fabric carried out in advance before it is used for the rubber blanket, to increase its density, brings a remarkable effect in the reduction of the sink-down of the rubber blanket. Thus, the technique of calendering the woven fabric used in a rubber blanket to make it highly dense, thereby suppressing the sink-down of the rubber blanket, has been widely employed.

However, rubber blankets that include a fabric layer that uses a calendered woven fabric have such properties that as the time passes, the woven fabric recovers its thickness before it was calendered. Thus, a rubber blanket that uses a calendered woven fabric cannot maintain its thickness stably for a long period of time, but the woven fabric recovers its original thickness. In this manner, it becomes easy for the rubber blanket to have the sink-down, which creates a problem.

Rubber blankets that employ a calendered woven fabric of, particularly, cotton fiber, polynosic fiber, rayon or mixture of these fibers, are sensitive to temperature and moisture and tend to recover their thickness to the thickness before the calendering. Thus, there are possibilities that rubber blankets which easily create sink-down are formed, which is a serious drawback.

The lithographic offset press uses dampening water during printing at all times. The damping water easily permeates inside the rubber blanket from the edge portion thereof during printing, and the water eventually will reach the fabric layer of the rubber blanket. When a portion of the damping water reaches the fabric layer of the rubber blanket, the fabric layer easily swells as it absorbs the water portion, and the portion of the fabric layer easily recovers the thickness before being calendered.

In the state described above, the rubber blanket regionally creates a difference in thickness between its edge portion and the other section. When such a difference is created, the printing pressure and transferring pressure are not constantly applied by the rubber blanket, but a difference is created between the edge portion and the other portion. Due to this drawback, there is conventionally a possibility of occurrence of printing troubles including uneven printing. Under these circumstances, there has been a demand for an invention of rubber blanket which rarely reduces its thickness by sink-down or rarely creates a regional difference in thickness, even after it is used in operation for a long period.

BRIEF SUMMARY OF THE INVENTION

The object of the present invention is to provide a durable rubber blanket designed to be used in lithography offset printing, which does not significantly reduce its thickness or regionally create a difference in thickness by the sink-down of the blanket, thereby making it possible to perform excellent printing for a long time.

In order to achieve the above-described object, there is provided according to an aspect of the present invention, a printing rubber blanket comprising a surface rubber layer and a compression layer provided on a lower surface of the surface rubber layer via an adhesive layer. Further, two or more fabric layers are provided on a lower surface of the compression layer via adhesive layers. Furthermore, the rubber blanket of the present invention employs a thick yarn of No. 10 count or less but No. 6 count or more for warps of woven fabric, and a slender yarn of No. 30 count or less but No. 20 count or more for wefts of the woven fabric in at least one of fabric layers, and the woven fabric is subjected to a stretching process in which the fabric is expanded in the warp direction.

In the rubber blanket of the present invention, which uses a particular woven fabric as described above in a fabric layer, the sink-down of the rubber blanket can be lessen and the reduction in the thickness of the rubber blanket can be suppressed. Further, it is possible to avoid the creation of a difference in thickness from one region to another. Consequently, the life of the blanket can be prolonged, and the gap between the plate cylinder and the rubber blanket can be maintained constantly at a predetermined distance for a long time, thereby making it possible to assure an appropriate printing pressure. Further, the gap between the rubber blanket and the impression cylinder can be set appropriately, and therefore the application of the pressure can be well adjusted, thereby making it possible to carry out excellent printing.

Additional objects and advantages of the invention will be set forth in the description which follows, and in part will be obvious from the description, or may be leaned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
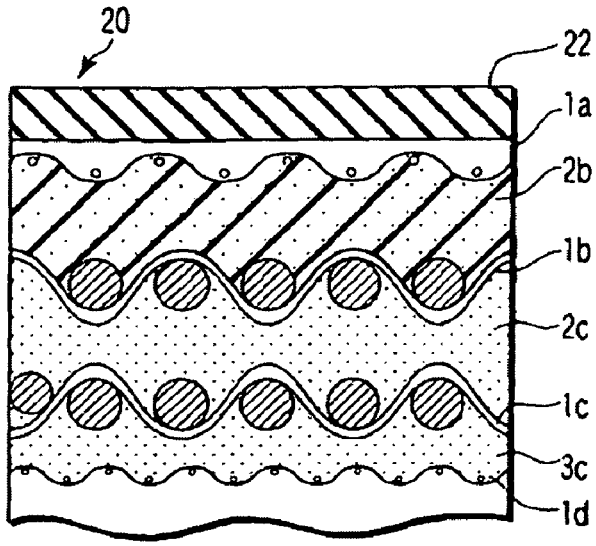
FIG. 1 is a diagram showing a cross section of a part of a rubber blanket according to an embodiment of the present invention.
Figure 2:
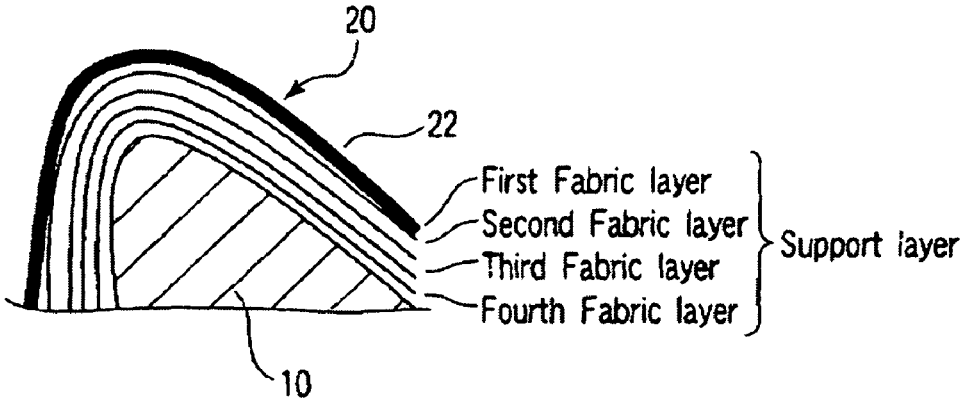
FIG. 2 is a diagram showing a cross section of a part of a rubber blanket according to the present invention, when it is placed on a cylinder.
Figure 3:
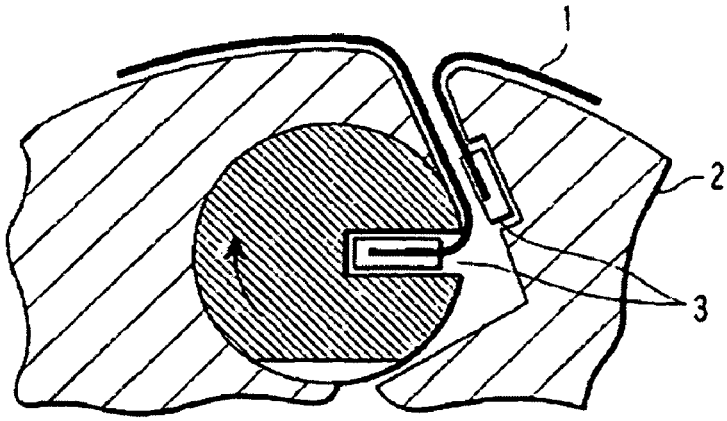
FIG. 3 (Prior Art)
FIG. 3 is a diagram showing a cross section of a part of a rubber blanket according to the conventional technique, when it is placed on a cylinder.

FIG. 1 illustrates a cross section of a part of a printing rubber blanket-according to the present invention. FIG. 2 is a partially enlarged view of the rubber blanket shown in FIG. 1 when it is mounted on a cylinder. FIG. 2 shows a cylinder 10 and a rubber blanket 20.

As shown in FIGS. 1 and 2, the rubber blanket 20 includes a surface rubber layer 22 on a surface of which ink is received and transferred, and a first fabric layer 1*a* adhered onto a lower surface of the surface rubber layer 22 with adhesive rubber glue. A thick compression layer 2*b* is adhered via an adhesive layer onto a lower surface of the first fabric layer 1*a*. Further, a second fabric layer 1*b*, a third fabric layer 1*c* and fourth fabric layer 1*d* are stacked via respective adhesive rubber layers 2*c* and 3*c* on a lower surface of the compression layer 2*b*. Apart from the above-described case, it is alternatively possible that the first fabric layer is adhered onto the lower surface of the compression layer 2*b* via an adhesive layer, and the second and third fabric layers are stacked underneath via respective adhesive layers. It is further alternatively possible that there is only one fabric layer provided in the blanket. The total thickness of the resultant rubber blanket is about 1.9 mm.

According to the present invention, the above-described rubber blanket 20 employs a yarn of No. 10 count or less but No. 6 count or more for warps of woven fabric, and a yarn of No. 30 count or less but No. 20 count or more for wefts of the woven fabric in at least one of fabric layers other than that adjacent to the surface rubber layer 22, and the woven fabric is subjected to stretching.

In other words, a thick yarn of No. 10 count or less but No. 6 count or more is used for the warps, whereas a slender yarn of No. 30 count or less but No. 20 count or more is used for the wefts to make the woven fabric, and the fabric is expanded in the warp direction for stretch process. In this manner, the woven fabric is set in such a state where the thick warps creates less difference in height between top and bottom it's the fabric's thickness direction and are aligned substantially linearly in its weaving direction of the fabric, and slender wefts are woven between the warps.

Figure 4:
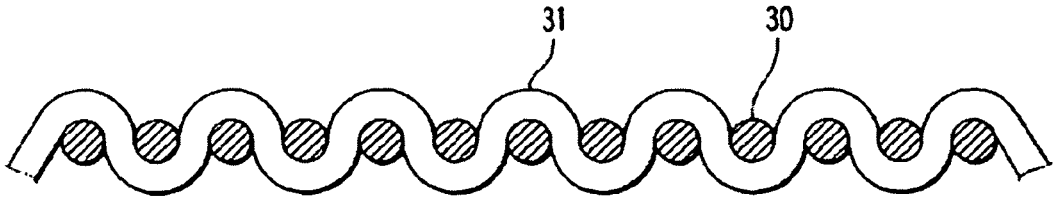
FIG. 4 (Prior Art)
FIG. 4 is a diagram showing a cross section, in a woof direction, of a textile stuff of woven fabric used in a fabric layer of a rubber blanket according to the conventional technique.
Figure 5:
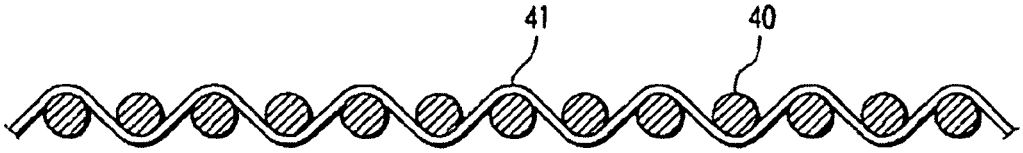
FIG. 5 is a diagram showing a cross section, in a woof direction, of a textile stuff of woven fabric used in a fabric layer of the rubber blanket of the present invention.

As compared to the conventional case, the conventional woven fabric uses warps and wefts, which have the same thickness or a little difference, which make the weft threads run up and down greatly in the fabric's thickness direction of the textile stuff. Therefore, the cross section of the conventional woven fabric shows that thick wefts are woven between warps to run up and down greatly. On the other hand, according to the present invention, thick warps and slender wefts are used and therefore the cross section of the woven fabric of its textile stuff shows such a state that there is a small difference between top and bottom of each weft. FIGS. 4 and 5 show an enlarged view of such states. FIG. 4 is a cross section of the textile stuff of the conventional woven fabric, whereas FIG. 5 is a cross section of the textile stuff of the woven fabric of the present invention. In FIG. 4, reference numeral 30 denotes a warp and reference numeral 31 denotes a weft 31, whereas in FIG. 5, reference numeral 40 denotes a warp and reference numeral 41 denotes a weft.

Figure 6:
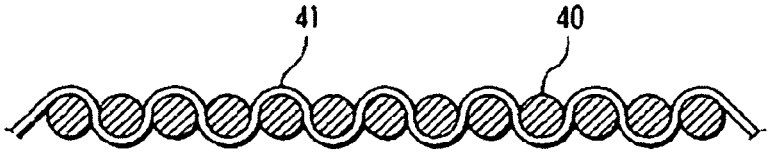
FIG. 6 is a diagram showing a cross section, in a woof direction, of woven fabric used in the fabric layer of the rubber blanket of the present invention, which was stretched in its warp direction.
Figure 7:
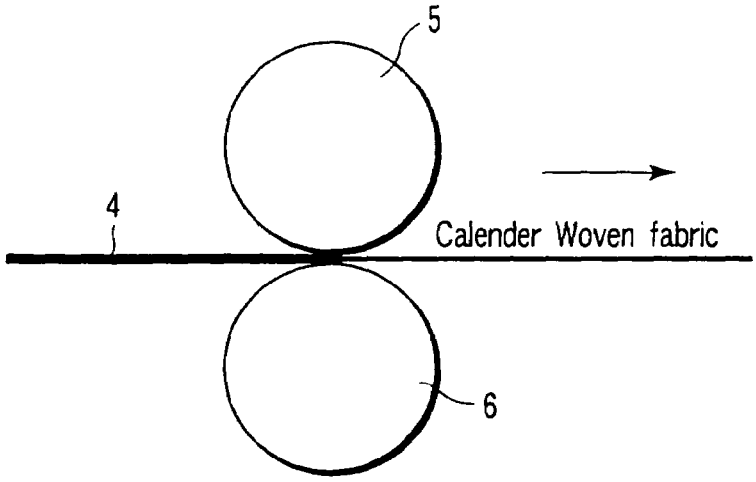
FIG. 7 is an explanatory diagram showing the woven fabric of the fabric layer of the rubber blanket while it is being calendered.

As is clear from FIG. 5, the textile stuff of the woven fabric of the present invention has such an arrangement that slender wefts 41 are woven between warps 40. With this arrangement, the cross section of the woven fabric shows the wefts 40 which have a difference smaller than that of the case of the conventional technique, between their tops and bottoms. Further, the woven fabric used in the present invention is subjected to stretching, where the fabric is further expanded in the warp direction (the longitudinal direction of the warps). With the stretching process, the swell of the warps 40 is stretched and further the gaps between adjacent ones of the warps 40 are narrowed to be dense, thereby making a woven fabric with a higher strength. FIG. 6 shows an enlarged cross section view of the above-described state of the woven fabric. In the woven fabric of the present invention, the warps 40 are each substantially linearly arranged side by side to be dense, and the slender wefts 41 are woven between the warps. With this texture, the woven fabric of the fabric layer of the blanket according to the present invention exhibits a sufficient strength and less sink-down even without being subjected to calendar process in advance.

By contrast, in the woven fabric used in the conventional blanket, the wefts are not sufficiently slender as compared to the warps and therefore the wefts that are woven between the warps run significantly up and down as can be seen in FIG. 4. Further, conventionally, such woven fabric is subjected to stretching, which makes the wefts arranged to run even more up and down, thereby increasing the thickness of the fabric. Therefore, in order to reduce the thickness, the woven fabric is subjected to calendering to press and squash it, before it is used. For this reason, a blanket that uses such woven textile is easily influenced by water depending on how it is used, and therefore it easily recovers its original thickness for sink-down to occur.

According to the present invention, the warps used for the woven fabric are yarns of No. 10 count or less but No. 6 count or more, and more specifically, those of No. 9 count or less but No. 7 count or more. When an excessively slender yarn is used for the warps, it is not possible to produce such a great difference of the thickness between the warps and wefts, and therefore a yarn of No. 10 count or less is used for the warps. On the other hand, when an excessively thick yarn is used for the warps, the texture becomes coarse, and therefore a yarn of No. 6 count or more is used for the warps.

With regard to the wefts, if an excessively slender yarn, which is more slender than those defined by the present invention, is used, a sufficient strength cannot be obtained in the texture. Therefore, a yarn of No. 30 count or less but No. 20 count or more, and more specifically, that of No. 30 count or less but No. 25 count or more is used. On the contrary to the above, when an excessively thick yarn is used for the wefts, the warps cannot be arranged each linearly and dense if the woven fabric is subjected to the stretching. Therefore, a yarn of No. 20 count or less is used for the wefts.

In the present invention, the maximum difference and minimum difference between the warps and wefts in thickness are as follows. That is, the maximum difference can be obtained when a yarn of No. 6 count is used for the warps and a yarn of No. 30 count is used for the wefts, whereas the minimum difference can be obtained when a yarn of No. 10 count is used for the warps and a yarn of No. 20 count is used for the wefts. In the conventional cases, it is usual to use a yarn of No. 10 to 15 count is used for the warps and a yarn of No. 10 to 20 count is used for the wefts. From the comparison, it can be understood that the ratio in thickness of the warps to the wefts in the present invention is larger than that of the conventional cases. It should be noted that there are the cotton yarn count number, hemp count number and wool count number, and in the present invention, the cotton yarn count is used.

According to the present invention, at least one of the fabric layers other than that adjacent to the surface rubber layer of the rubber blanket is made to have the above-described texture. Rubber blankets usually include a surface rubber layer, the first fabric layer adhered to the surface rubber layer, and a plurality of layers underlying these, such as the second fabric layer and the third fabric layer. According to the present invention, at least one of these plurality of underlying fabric layers is made to the have the above-described textile. Naturally, it is fine that the woven fabric of two or more fabric layers or even all of the fabric layers are formed to have the above-described texture. The first fabric layer is adhered to the surface rubber layer such as to be integrated therewith, and with this textile, there is a low possibility that the thickness thereof is reduced after a long period of use. However, in the present invention, the woven fabric of the fabric layer as well may be formed to have the above-described textile.

In the present invention, the woven fabric having the above-described textile is subjected to stretching. The stretching process applied here is the same as the one carried out in the process of manufacturing of the conventional blanket fabric. For example, in the stretching process, the woven fabric made of the warps and wefts of the above-described textile is held by its edges and it is expanded in the warp direction. In the case where the present invention is employed for woven fabric of a plurality of layers, the stretching process is carried out for each one by one, and then these layers are stacked and adhered to each other.

In the stretching process, the residual ductility of the woven fabric is set within a range of 3.5 to 6.5%. When the residual ductility is less than 3.5%, it indicates that an excessive stretching force has been applied, which results in the lowering of the tensile strength of the warps. On the other hand, when the residual ductility exceeds 6.5%, there is no problem in terms of strength; however, the stretching is not sufficient so that a large difference is created in the warps between top and bottom in the thickness direction of the fabric, and the warps cannot be arranged linearly in the longitudinal direction of the warps. Thus, it is not possible to obtain an excellent blanket having less sink-down in the fabric layers and less variation in thickness.

The invention recited in claim 3 is based on the invention of claim 1 and a further limitation is provided, in which the number of warps in the textile stuff of the woven fabric is set to 55 to 75 per 1 inch, and the ratio of the number of warps to that of wefts is set 1.1 times or more. In other words, a yarn thicker than that used for the wefts is used for the warps and further, the number of warps per 1 inch is set in the above-described range and the number of warps is set to be 1.1 times or more than the number of wefts. When the ratio is set to 1.1 times or more, the density of thick warps is increased in the woven fabric, and the difference between top and bottom of the warps can be further reduced in the thickness direction. Thus, the warps are each aligned linearly side by side in the weaving direction of the fibers, and the slender wefts are arranged to weave between the warps, respectively.

The residual ductile set by the stretching process, recited in claim 5, is as described above. The invention of claim 6 specifies the materials for the warps and wefts, and it defines that either one of or both of warp and weft is of cotton fiber, polynosic fiber, nylon fiber, polyester fiber, polyvinylalcohol fiber, polyolefin fiber, acryl fiber, rayon fiber, or cotton cloth fiber or a blended yarn of these fibers.

The residual ductile set by the stretching process, recited in claim 3, is as described above. The invention of claim 4 specifies the materials for the warps and wefts, and it defines that either one of or both of warp and weft is of cotton fiber, polynosic fiber, nylon fiber, polyester fiber, polyvinylalcohol fiber, polyolefin fiber, acryl fiber, rayon fiber, or cotton cloth fiber or a blended yarn of these fibers.

The present invention is similar to that of the conventional technique except for the above-described structure in which the woven fabric of at least one of the fabric layers of the blanket is made to have the above-described texture. That is, as shown in FIG. 1, 2 or more, usually, 3 or 4 fabric layers are adhered together with adhesive to form a stack layer, and a compression layer 2*b* having a predetermined thickness is adhered onto the stacked layer. Further, a surface rubber layer 22 on a bottom surface of which a fabric layer 1*a* is adhered, is formed on the resultant stacked layer.

Examples 1 to 9, Comparative Examples 1 to 8

Sulfur, a vulcanization stabilizer, an antioxidant, a reinforcing agent and a plasticizer were mixed into 100 parts by weight of nitrile rubber (NBR), and the mixture was dissolved into methylethylketone to prepare mucilage (to be called as "adhesive mucilage"). Apart from this adhesive mucilage, 20 parts by weight of microballoon of a copolymer of methacrylonitryl and acrylonitryl (tradename: Expansel 091DE of Novel Industry Co., Inc.) was added to mucilage obtained in the same manner as described above and uniformly mixed to prepare mucilage containing microballoon as well. In both mucilage materials, dibenzothiazol was used as vulcanization accelerator.

The microballoon-free adhesive mucilage was applied uniformly on the second fabric layer 1*b* having a thickness of about 0.4 mm as shown in FIG. 1. Then, the microballoon-containing adhesive mucilage was applied as a coating having a thickness of 0.35 mm thereon in order to form a compression layer 2*b*. The layer of the microballoon-containing adhesive mucilage is formed into the compression layer 2*b* which has a cushion property by further vulcanizing it. Further, the adhesive mucilage was uniformly applied onto the surface of the first fabric layer, and the first fabric layer 1*a* was adhered on the compression layer 2*b*.

The third fabric layer 1*c* and the fourth fabric layer 1*d* were adhered to each other via the adhesive layers 2*c* and 3*c*, respectively, on an opposite side of the second fabric layer 1*b*. Lastly, a sheet-like member of a nitrile rubber mixture was stacked on the first fabric layer 1*a* via adhesive mucilage applied thereon, thereby forming the surface rubber layer 22.

An unvulcanized compressed rubber blanket prepared as above was wrapped around a metal-made drum, and the resultant was placed in an inner container of a double can in which vapor of 150° C. was introduced in an outer container. Then, the can was heated for 6 hours and thus the vulcanization was completed. After that, the blanket-wrapped drum was unloaded from the can and cooled. Subsequently, the surface rubber layer 22 was polished with sand paper of 240 mesh and thus a blanket having a thickness of 1.9 mm was obtained.

In a similar manner to that of the above-described example, Examples 1 to 9 were prepared to present the following variations. That is, in each case, a yarn of No. 10 count or less but No. 6 or more was used for the warps of the woven fabric and a yarn of No. 30 count or less but No. 20 or more was used for the wefts, and the ratio between the number of warps to that of wefts per 1 inch was changed from 1.1 to 1.4. The woven fabric of each of the first to fourth fabric layers was subjected to the stretching process in which the woven fabric was stretched in the warp direction. The residual ductility of the woven fabric subjected to the stretching process was indicated in TABLE 1 each case. In each case, the number of warps per in inch in the woven fabric was set to 55 to 75. Whether or not the sink-down (reduction in thickness) takes places in the woven fabric of the rubber blanket was examined in the following manner.

A blanket cylinder having a diameter of 343.7 mm and a length of 480 mm and an impression cylinder having a diameter of 347.8 mm and a length of 480 mm were used.

In each test, a respective one of the above-described various types of blankets was wound around the blanket cylinder, and the cylinder was rotated 200,000 times at a revolution of 500 ppm at an applied pressure (squeeze) of 0.2 mm before the variation amount was measured. The variation amount was expressed in terms of the ratio (%) of the reduced thickness to the thickness of the blanket immediately after it was wrapped around the blanket cylinder.

If the reduction of the thickness that is expressed by the variation ratio to the thickness of the blanket after the above examination was less than 10%, the example was evaluated as ○, whereas the reduction of the thickness exceeds 10%, the example was evaluated as X. The woven fabric having a variation ratio of less than 10% has less reduction in the thickness of the fabric layer, and therefore it exhibits not significant adverse effect on the printing performance. When the ratio exceeds 10%, such woven fabric cause a significant effect on the printing performance. The results obtained in the tests were as indicated in TABLE 1.

Comparative Examples each are the cases where at least one of the count number of warps, count number of wefts, ratio between the number of warps to that of wefts fell out of the range defined by the present invention. Further, in each comparative example, the residual ductility was excessive, and the stretching process was slightly insufficient or insufficient. The results of Comparative Examples were shown in TABLE 1.

TABLE 1

| | Examples and Comparative Examples | | | | | | | | | | | | | | | | |
|---|---|---|---|---|---|---|---|---|---|---|---|---|---|---|---|---|---|
| | EXAMPLES | | | | | | | | | COMPARATIVE EXAMPLES | | | | | | | |
| | 1 | 2 | 3 | 4 | 5 | 6 | 7 | 8 | 9 | 1 | 2 | 3 | 4 | 5 | 6 | 7 | 8 |
| Count number for Warps | 6 | 7 | 7 | 8 | 8 | 9 | 9 | 10 | 10 | 5 | 6 | 7 | 7 | 10 | 11 | 11 | 11 |
| Count number for Wefts | 20 | 20 | 23 | 23 | 25 | 25 | 28 | 28 | 30 | 19 | 18 | 19 | 21 | 31 | 31 | 19 | 31 |
| Ratio between the number of warps and that of wefts | 1.1 | 1.1 | 1.1 | 1.2 | 1.2 | 1.2 | 1.3 | 1.3 | 1.4 | 1.1 | 1.1 | 1.1 | 1.2 | 1.3 | 1.5 | 1.1 | 1.3 |
| Residual ductility (%) | 3.5 | 4.0 | 4.3 | 4.3 | 4.5 | 4.5 | 5.0 | 5.5 | 6.5 | 3.5 | 3.5 | 6.7 | 7.1 | 7.2 | 4.0 | 3.5 | 7.1 |
| Sink-down of Fabric Occurred | ○ | ○ | ○ | ○ | ○ | ○ | ○ | ○ | ○ | X | X | X | X | X | Δ* | X | X |

*Comparative Example 6 had a nearly good condition in terms of sink-down, but was insufficient in terms of tensile strength.

As shown in TABLE 1, all of Examples 1 to 9 exhibited less sink-down in the woven fabric and were evaluated as ○, which means a good result. As compared to these, Comparative Example 1 exhibited large sink-down, in which a yarn of the No. 5 count was used for the warps, which was thicker and fell out of the range of No. 6 count or more defined by the present invention, and a yarn of the No. 19 count was used for the wefts, which was thicker and fell out of the range of No. 20 count or more defined by the present invention. Comparative Example 2 exhibited large sink-down, in which a yarn of the No. 18 count was used for the wefts, which was thicker and fell out of the range of No. 20 count or more defined by the present invention. In Comparative Example 3, a yarn of the No. 19 count was used for the wefts, which was thicker and fell out of the range of No. 20 count or more defined by the present invention and the residual ductility was 6.7%, which indicated insufficient stretching, and this comparative example exhibited a large variation ratio in the fabric layer and an adverse effect in the printing performance.

In Comparative Example 4, a yarn of the No. 7 count was used for the warps, and a yarn of the No. 21 count was used for the wefts, both of which fell within the range defined by the present invention, but the residual ductility was 7.1%, which indicated insufficient stretching. The results indicate that this comparative example exhibited a large variation ratio in the fabric layer. In Comparative Example 5, a yarn of the No. 10 count was used for the warps, and a yarn of the No. 30 count was used for the wefts, both of which fell out of the range defined by the present invention, and the residual ductility was 7.2%, which indicated insufficient stretching. The results indicate that this comparative example exhibited a large variation ratio in the fabric layer. In Comparative Examples 6 to 8, yarns used for the warps and/or wefts fell out of the range defined by the present invention. The results indicate that these comparative examples each exhibited a large variation ratio in the fabric layer.

Example 10

Figure 8:
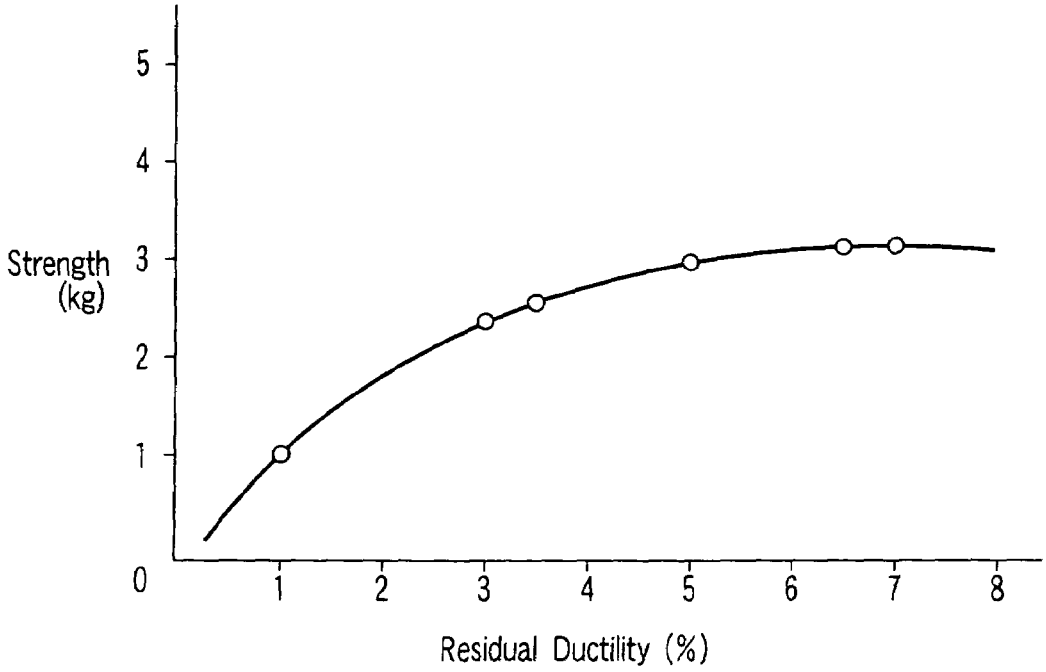
FIG. 8 is a chart illustrating the relationship between the residual ductility (%) after the woven fabric is subjected to stretching and the tensile strength (kg) of the rubber blanket that employs the fabric layer of this woven fabric.

The blanket obtained in Example 1 was subjected to tensile strength test while the residual ductility of the woven fabric was varied 1%, 3%, 3.5%, 5%, 6.5% and 7%. The results were as shown in FIG. 8.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A printing rubber blanket comprising:

a surface rubber layer;

a compression layer provided below the surface rubber layer; and two or more fabric layers provided below the surface rubber layer;

wherein at least one of the two or more fabric layers is woven fabric made of a yarn of No. 10 count or less but No. 6 count or more used for warps of the woven fabric, and a yarn of No. 30 count or less but No. 20 count or more used for wefts of the woven fabric, and the woven fabric is subjected to a stretching process having a residual ductility of 3.5 to 6.5% after being stretched in which the woven fabric is expanded in the warp direction, thereby the rubber blanket does not significantly reduce its thickness by sinkdown.

2. The printing rubber blanket according to claim 1, wherein the number of warps of the woven fabric of the fabric layer subjected to the stretching process per 1 inch of textile stuff is 55 to 75 and the number of warps per 1 inch is 1.1 times or more than that of wefts.

3. The printing rubber blanket according to claim 1, wherein the woven fabric of the fabric layer subjected to the stretching process employs a yarn of No. 9 count or less but No. 7 count or more used for warps, and a yarn of No. 30 count or less but No. 25 count or more used for wefts.

4. The printing rubber blanket according to claim 1, wherein either one of or both of warp and weft comprises one of cotton fiber, polynosic fiber, nylon fiber, polyester fiber, polyvinylalcohol fiber, polyolefin fiber, acryl fiber, rayon fiber and cotton cloth fiber, or a blended yarn of these fibers.

5. A printing rubber blanket comprising:

a surface rubber layer;

a first fabric layer provided on a lower surface of the surface rubber layer;

a compression layer provided on a lower surface of the first fabric layer; and one or more fabric layers provided on a lower surface of the compression layer;

wherein at least one of the one or more fabric layers provided on the lower surface of the compression layer is woven fabric made of a yarn of No. 10 count or less but No. 6 count or more used for warps of the woven fabric, and a yarn of No. 30 count or less but No. 20 count or more used for wefts of the woven fabric, and the woven fabric is subjected to a stretching process having a residual ductility of 3.5 to 6.5% after being stretched in which the woven fabric is expanded in the warp direction, thereby the rubber blanket does not significantly reduce its thickness by sinkdown.

6. The printing rubber blanket according to claim 5, wherein the number of warps of the woven fabric of the fabric layer subjected to the stretching process per 1 inch of textile stuff is 55 to 75 and the number of warps per 1 inch is 1.1 times or more than that of wefts.

7. The printing rubber blanket according to claim 5, wherein the woven fabric of the fabric layer subjected to the stretching process employs a yarn of No. 9 count or less but No. 7 count or more used for warps, and a yarn of No. 30 count or less but No. 25 count or more used for wefts.

8. The printing rubber blanket according to claim 5, wherein either one of or both of warp and weft comprises one of cotton fiber, polynosic fiber, nylon fiber, polyester fiber, polyvinylalcohol fiber, polyolefin fiber, acryl fiber, rayon fiber and cotton cloth fiber, or a blended yarn of these fibers.

9. A printing rubber blanket comprising:

a surface rubber layer;

a compression layer provided on a lower surface of the surface rubber layer; and one or more fabric layers provided on a lower surface of the compression layer;

wherein at least one of the one or more fabric layers is woven fabric made of a yarn of No. 10 count or less but No. 6 count or more used for warps of the woven fabric, and the woven fabric is subjected to a stretching process having a residual ductility of 3.5 to 6.5% after being stretched in which the woven fabric is expanded in the warp direction, thereby the rubber blanket does not significantly reduce its thickness by sinkdown.

10. The printing rubber blanket according to claim 9, wherein the number of warps of the woven fabric of the fabric layer subjected to the stretching process per 1 inch of textile stuff is 55 to 75 and the number of warps per 1 inch is 1.1 times or more than that of wefts.

11. The printing rubber blanket according to claim 9, wherein the woven fabric of the fabric layer subjected to the stretching process employs a yarn of No. 9 count or less but No. 7 count or more used for warps, and a yarn of No. 30 count or less but No. 25 count or more used for wefts.

12. The printing rubber blanket according to claim 9, wherein either one of or both of warp and weft comprises on of cotton fiber, polynosic fiber, nylon fiber, polyester fiber, polyvinylalcohol fiber, polyolefin fiber, acryl fiber, rayon fiber and cotton cloth fiber, or a blended yarn of these fibers.

* * * * *